United States Patent [19]

Clinkscales

[11] Patent Number: 5,010,665

[45] Date of Patent: Apr. 30, 1991

[54] MODULAR ELECTRONIC BADGE

[76] Inventor: Cornell Clinkscales, 105 Catlin Cir., Greenville, S.C. 29607

[21] Appl. No.: 847,511

[22] Filed: Apr. 3, 1986

[51] Int. Cl.[5] ..... A44C 3/00

[52] U.S. Cl. ..... 40/1.5; 40/1.6; 40/442; 40/455

[58] Field of Search ..... 40/1.5, 10 R, 1.6, 455, 40/152.2, 902, 442, 443; 362/203, 208, 206, 104; 446/175, 295, 369

[56] References Cited

U.S. PATENT DOCUMENTS

| | | | |
|---|---|---|---|
| D. 279,910 | 7/1985 | Detro | 40/1.5 |
| 3,378,680 | 4/1968 | Moxley | 226/51 X |
| 3,508,041 | 4/1970 | Sweany et al. | 362/104 |
| 3,522,426 | 8/1970 | Franc | 40/152.2 |
| 3,805,047 | 4/1974 | Dockstader | 362/104 |
| 3,818,209 | 6/1974 | Roth | 362/104 |
| 3,918,184 | 11/1975 | Chao | 40/1.5 |
| 4,076,976 | 2/1978 | Fenton | 362/104 |
| 4,215,388 | 7/1980 | Reimann . | |
| 4,285,030 | 8/1981 | Menelly | 362/208 X |
| 4,368,507 | 1/1983 | Reynolds | 362/208 X |
| 4,531,310 | 7/1985 | Ascon et al. | 40/1.5 |
| 4,556,932 | 3/1985 | Lehrer et al. | 40/10 R |

OTHER PUBLICATIONS

Hammacher Schlemmer Spring Supplement Catalog 1985, p. 22.

Proton 320 Owner's Manual, p. 5.

*Primary Examiner*—Kenneth J. Dorner

*Assistant Examiner*—J. Hakomaki

*Attorney, Agent, or Firm*—Dority & Manning

[57] ABSTRACT

A modular electronic message badge has a detachable lamp unit which contains a light bulb associated with an interchangeable lens cover. A power pack unit provides one protected enclosure for receipt of electronic components or circuitry, and another portion defining a chamber, which opens to the exterior of the power pack unit for receipt of a battery. Introduction and removal of a battery from the chamber automatically switches on and off the electronic circuitry protectively enclosed within the power pack unit without requiring that such unit be opened. The lamp unit is physically attached to the power pack unit for support thereon and electrically connected therewith so that the light bulb is powered by an output of the electronic circuitry. The lens cover may be partially transparent and provided with a selected message or design. The cover is backlighted by the lamp to display the message intermittently, under the control of the power pack unit.

19 Claims, 2 Drawing Sheets

MODULAR ELECTRONIC BADGE

BACKGROUND AND SUMMARY OF THE INVENTION

This invention concerns a modular electronic badge which can illuminate an associated design or slogan, or otherwise highlight same. More specifically, it concerns an electronic message badge which can be worn or carried by a user, and which has an automatic on/off switching function achieved by direct manipulation of a battery received within a chamber of a power pack unit.

In the field of novelty items, low cost and uniqueness are desirable features. However, in general, the lower the cost of manufacture, the lower the perceived quality (and hence, value) of the item. Additionally, the life span of a novelty item may not only be reduced by the initial low quality or inexpensive construction of the product, but also by obsolescence of the message which it conveys.

Typical electronic novelty items are battery operated for portability and convenience. Many of such items require the user to open and close a housing to change the battery. Examples of such prior devices are disclosed by Fenton (U.S. Pat. No. 4,076,976) and Reimann (U.S. Pat. No. 4,215,388). If the novelty item is made of inexpensive plastics or the like, such opening and closing tends to wear out the housing or a hinge thereof such that it eventually fails, which renders the product useless. Batteries which power both the Fenton and Reimann devices are retained within enclosed housings of such device, which housings must be opened to gain access to the batteries.

Further, many battery-operated novelty items, including those of both Fenton and Reimann cited above, require an electrical switching system to engage or disengage their operation. In a manner analagous to the wearing out of hinges while introducing and removing batteries as noted above, electrical switches can wear out and ultimately fail. Such failure also renders the product useless.

As noted above, if a novelty item is constructed so as to convey only one specific non-changeable message, the entire novelty device may become obsolete whenever the particular message stated is no longer of interest to the user. Moreover, the cost to a manufacturer of such products with limited, unchangeable messages is undoubtedly higher since each such item must be custom made in accordance with market predictions of interest in various slogans which may be associated with the novelty items. In addition to such higher manufacturing costs, retailers are also required to maintain a higher volume of inventories to provide the variety of messages which may be demanded by consumers.

It is a general object of the present invention to recognize and overcome numerous of such drawbacks of prior novelty items. More specifically, it is an object of the present invention to provide a battery-operated device having a housing which permits introduction and removal of a battery from such housing without requiring the opening thereof. Such a feature protects electronic components enclosed within such housing from dust, dirt, and physical contact which can erode their performance and cause their failure. If electronic components are continuously protected within a housing constructed in accordance with the present invention, their effective lifetime will not be shortened by dirt and physical contact which they would otherwise be subjected to if they were exposed each time a battery was replaced (such as in the devices of Reimann and Fenton) or an electrical switch actuated.

A further object of this invention is to obviate the need for electrical switches which are frequently used for actuation of prior devices, so that the failure problem of such switches is eliminated.

Yet another object of this invention is to provide a relatively high quality novelty message item or badge which may be marketed with a variety of messages at modest cost, but without the usual higher manufacturing costs or inventory costs associated with providing a plurality of different single message novelty items.

It is still a further object of this invention to provide a relatively high quality and long-lasting apparatus embodying all of the foregoing desirable features as well as additional features, while still being made at relatively low cost and from light-weight material which can be unobtrusively worn by a user.

Another object of the present invention is to provide a novelty device which includes electronic circuitry which causes a light to flash for drawing attention to the message being displayed, or otherwise produces audible tones or sounds performing such function.

The features and teachings of the present invention may be embodied in a variety of constructions and embodiments. For example, in accordance with one form of the present invention, an electronic apparatus may be provided which has a first housing having electronic circuitry enclosed therein, the first housing defining a chamber which opens to the exterior of such first housing; and a second housing having an electrical load enclosed therein, the second housing being adapted for physical and electrical association with the first housing, whereby the electrical load may be driven by the electronic circuitry.

In still another construction in accordance with the teachings of the present invention, a modular electronic badge may be provided, comprising: a power unit defined by a housing having (a) a first portion for enclosing electronic components, (b) a second open portion for receipt of a battery, (c) first electrical contact means for supplying power to a battery received within the second portion to the electronic components, and (d) second electrical contact means which supply an electrical output from the electronic component to the exterior of the housing, whereby introduction and removal of a battery in and out of the second open portion automatically switches power on and off between the battery and the electronic components; and such modular electronic badge further having a lamp unit adapted for attachment to the exterior of the power unit housing for physical support of such lamp unit, and for operative association with the second electrical contact means, wherein the lamp unit includes an electric light received within it and controlably powered by the electronic components associated with the power unit.

In yet another embodiment constructed in accordance with the present invention, and including further features thereof, a battery-operated modular electronic novelty badge is provided, comprising a power pack unit adapted to be worn by a user, having electronic circuitry protectively enclosed within it, and defining a chamber which opens up to the exterior of the power pack to permit introduction and removal of a battery without having to open the power pack unit; electrical contact means, associated with the power pack unit, for electrically connecting a battery received within the chamber with the electronic circuitry, and for providing electrical output from the electronic circuitry; and a lamp unit having an electric light, the lamp unit being adapted to be physically supported by the power pack unit and operatively associated with the electrical contact means so that the electric light is controlably powered by the electronic circuitry, whereby introduction and removal of a battery from the power pack unit automatically switches on and off power from such battery being transferred between the electronic circuitry and the electric light.

These and numerous other teachings and features of the present invention will be better understood by one of ordinary skill in the art upon studying the complete disclosure of this invention, which is further found in the remaining portion of the specification.

BRIEF DESCRIPTION OF THE DRAWINGS

This invention may be better understood from a study of the following complete and enabling disclosure thereof, taken in conjunction with the accompanying figures, in which.

Figure 1:
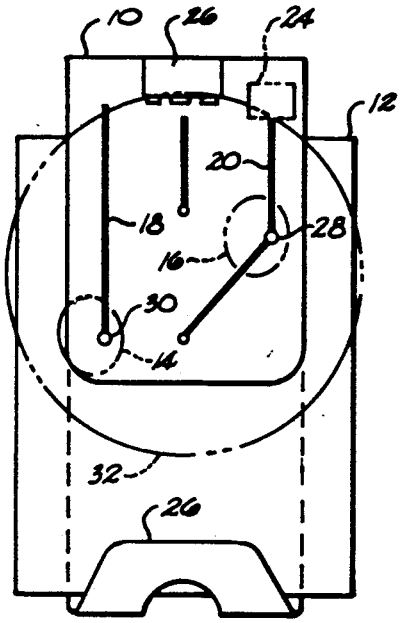
FIGS. 1 and 2 illustrate a front perspective view and a side view, respectively, of a first embodiment constructed in accordance with the present invention.

Repeat use of reference characters in the figures and in the specification is intended to indicate the same or analogous elements.

DETAILED DESCRIPTION OF THE PREFERRED EMBODIMENTS

Figure 2:
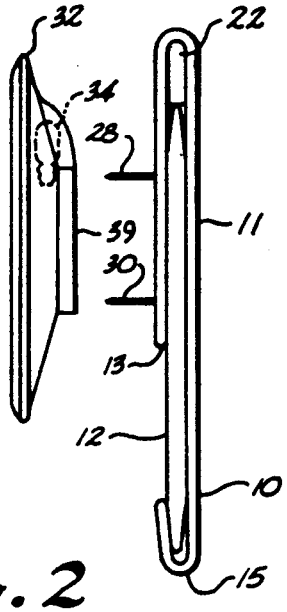

Referring to FIGS. 1 and 2, a modular electronic badge includes a substantially rectangular and planar (i.e., relatively flat profile) housing 10 which slidably receives and engages a flat-pack battery 12. Battery 12 may comprise any standard flat-pack type battery, such as the Polaroid "pola-pulse", model number P-100 or P-500, which is a 6-volt battery having the approximate dimensions of 3.0 inches by 3.675 inches by 0.15 inches. Battery 12 has a negative pad 14 and a positive pad 16 located on one planar side thereof for defining electric terminals. First electrical connection means, defined by illustrated elements such as inner-connecting wires 18 and 20, connect the battery terminal pads with electronic circuitry enclosed within first portion 22 of first housing 10.

As more clearly illustrated in FIG. 2, first housing 10 has a back member 11 and a smaller front member 13 which frictionally engage battery 12 between them. A curved bottom portion 15 also assists in engaging the battery. Connecting wires 18 and 20 may be associated with front member 13 so as to also connect directly with pin members 28 and 30 (discussed more fully below).

Electronic circuitry or components may be protectively received in portion 22 enclosed near the top of first housing 10. Such components may include a variety of elements such as a conventional integrated circuit chip 24 or a capacitor 26. A minimum of space is needed in such a first portion for purposes of receiving a simple circuit sufficient to provide function or functions as discussed below.

The electronic circuitry or components received in portion 22 may typically comprise a conventional flashing circuit, the details of which do not form an essential feature of this invention and hence for the sake of brevity are not repeated here. The flashing circuit may be established with virtually any variety of on/off duty ratios. A ratio of 1:5, for example, provides an effective balance between saving battery power and displaying a message. Such a flashing circuit may be comprised of individual electrical components known to those of ordinary skill in the art. Alternatively, conventional integrated circuit chips are available to equivalently perform the same function, but are not preferred because static electricity typically associated with clothing worn by a user, or any other stray charges, may cause damage to such chips. A circuit comprising individual components is not as subject to such damage.

In addition to flashing circuits, the electronic circuitry or components may include integrated circuit elements which generate audible tones or sounds, such as a CMOS melody chip. For example, these may include a variety of commercially available chips, such as CIC 3830, CIC 3850, or CIC 285. Similarly, a simple speech chip may be utilized, such as the ERSO-CIC-5601.

First housing 10 slidably engages battery 12 by providing a second portion defining a chamber which opens to the exterior of the housing. In the embodiment of FIGS. 1 and 2, the friction fit space between back member 11 and front member 13 define such a second portion. Clip 26 completed by curved bottom portion 15 cooperates with the remainder of the illustrated structure to receive and frictionally engage battery 12.

As is readily apparent to those skilled in the art, whenever battery 12 is slidably placed into the chamber defined by housing 10, polarity pads 14 and 16 thereof may eventually when properly positioned make contact with the first electrical contact means (previously described), which automatically cuts on electronic circuitry received within portion 22 of housing 10. Similarly, it is further apparent that even slight displacement of the battery such that pads 14 and 16 thereof do not come into such alignment with electric lines 18 and 20 causes power to electronic components 24 and 26 to be interrupted, automatically cutting off operation of same. Therefore, movement of battery 12 into and out of the chamber portion defined by housing 10 automatically provides an on/off switching function for a modular electronic badge in accordance with the present invention, without requiring any external switching mechanisms which can become worn and inoperative. Also, it is not necessary to open any portion of first housing 10, and thereby expose any of the electrical components protectively enclosed within, in order to manipulate the battery.

Pin elements 28 and 30 (comprising upright rigid members) extend from housing 10 to function as a second electrical contact means, providing output from the electrical components received within portion 22 of housing 10 to a second housing or lamp unit 32. Second housing 32 may enclose an electric light, such as conventional incandescent bulb 34. As is understood without the necessity of illustration, lead wires extend from such bulb to facilitate application of power to the bulb from a power source.

Second housing 32 further defines a plurality of openings (not shown in FIG. 2, but illustrated in FIG. 3) which are adapted to receive upright rigid members 28 and 30 therein. Mounting of unit 32 on such rigid members provides physical support for second housing 32, while also providing for the transfer of electrical power to bulb 34 from the electrical components and battery associated with first housing 10. The specifics of such connections are discussed further below with reference to FIG. 3.

Figure 3:
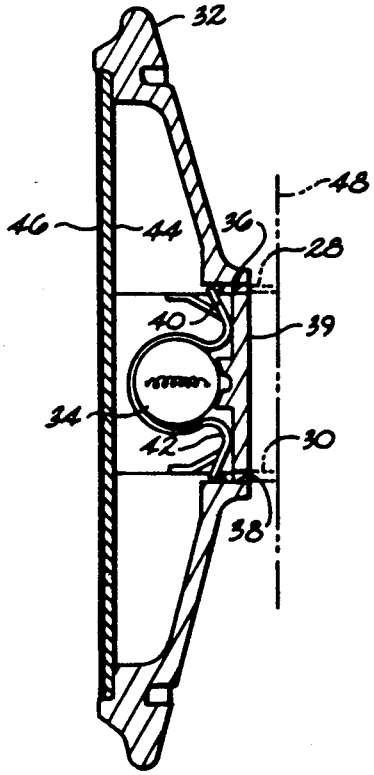
FIG. 3 illustrates an enlarged and top view of a detachable lamp unit functional with various embodiments of this invention, particularly the embodiment illustrated in FIGS. 1 and 2.

FIG. 3 illustrates an enlarged and top view of second housing 32, which comprises a lamp unit. In the embodiment illustrated in FIGS. 1 and 2, lamp unit 32 may be detachably associated with housing 10. Pins 28 and 30 are received in openings 36 and 38, respectively, defined by second housing 32. As may be seen from FIG. 1, pins 28 and 30 are actually diagonally disposed with respect to each other; hence, openings 36 and 38 are likewise diagonally disposed. Openings 36 and 38 comprise a selected pair of openings which matingly engage pins 28 and 30, and establish a particular orientation for housing 32 with respect to housing 10.

Additional openings, not illustrated, are present in a back portion 39 of housing 32. Mating of pins 28 and 30 with selected pairs of such openings permits alternative orientations for housing 32 relative housing 10. In one preferred embodiment, four such openings may be defined in squared relationship relative one another on back 39 of housing 32, thereby permitting selected rotation of housing 32 with respect to housing 10 at 90 or 45 degree intervals.

Spring-loaded contacts 40 and 42 are associated with openings 36 and 38 so as to complete a series electrical connection for lamp 34 with the electrical output from the electronic circuitry contained within portion 22 of housing 10. Of course, remaining openings of housing 32 which are not illustrated in FIG. 3 also would have such contacts associated therewith for similar purpose of powering lamp 34. Lamp 34 may comprise an incandescent bulb, LED, or any similar and equivalent lighting means.

As is illustrated, lamp 34 is received within housing 32. One side of housing 32 generally opposing lamp 34 is sealed by a transparent member 44. Lamp 34 may be partially surrounded by a conventional reflector element (not illustrated) for the purpose of directing its light towards member 44. On the face of transparent member 44 may be found an overlay member 46, which may comprise black solar-resistive plastic. Such plastic appears to be opaque whenever it is not backlighted. Whenever backlighted, however, differential portions thereof permit the light from behind to be visible.

Transparent member 44 and face member 46 associated therewith may collectively comprise a removable lens which may be frictionally fit with lamp unit 32, as illustrated in FIG. 3. The differential portions of overlay face 46 may establish a design, printed subject matter, or the like, which matter is displayed or highlighted whenever light is supplied from behind by lamp 34. Since the lens itself may be interchanged with other lenses, the message, logo, or design displayed by a modular electronic badge constructed in accordance with this invention may be readily changed. Hence, some of the high manufacturing and inventory costs discussed above may be reduced, if not eliminated.

With respect to use of a modular electronic badge constructed as illustrated in FIGS. 1-3, first housing 10 may be concealed behind an article of clothing so that pins 28 and 30 protrude therefrom, with second housing 32 being subsequently mounted on the pins. Broken line 48 of FIG. 3 is intended to represent an exemplary article of clothing, such as a shirt or jacket, worn by a user of the badge. Inasmuch as pins 28 and 30 have a relatively small diameter, and carry substantially low voltages, first housing 10 may be concealed within or behind such article of clothing with virtually no danger or inconvenience. Lamp unit 32 may be mounted on pins 28 and 30 protruding from such clothing. Hence, only lamp unit 32, with its flashing message or the like, is visible to someone perceiving this embodiment of the invention being worn or employed in such manner by a user.

Furthermore, a user may easily control on/off switching of the electrical operation of the modular electronic badge when so worn by simply manipulating the battery through the article of clothing so that the battery is slightly displaced from one side or the other to switch on or off the electronic components, as desired. No other electrical switch need be actuated through the clothing, and the badge need not be removed from behind the clothing to effect such switching.

Alternatively, it may be desired to provide a modular electronic badge which does not require that pins be secured through ones clothing. In such instance, housing 10 may readily be provided with some other means, such as connectors for a chain or necklace or the like so as to be worn around the neck, wrist, torso, etc. of a user.

Figure 4:
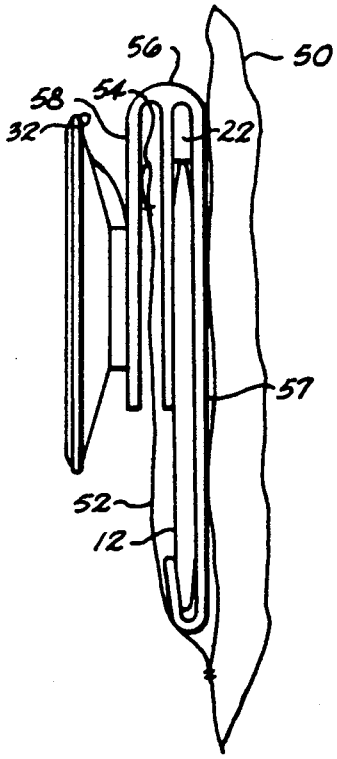
FIG. 4 illustrates another embodiment of this invention, which primarily is a modification of the embodiment of FIGS. 1 and 2 adapted particularly for use with a standard pocket.

FIG. 4 illustrates yet another variation which may be utilized in accordance with the features of this invention to avoid any need for pins to be stuck through ones clothing. FIG. 4 illustrates a variation of housing 10, shown in intended relationship with the cross-section of a standard shirt with a front pocket. Shirt 50 has a pocket 52 which is generally rectangular in shape and has an opening across its upper side. Since FIG. 4 represents a cross-section of such a shirt, it is understood that the upper lip 54 of pocket 52 actually wraps around on either side thereof to rejoin shirt 50, and thereby define an open slit across the top of pocket 52.

Housing 10 is replaced with a modified first housing 56, which has two bifurcated planar sections. Battery 12 and portion 22 for receiving electronic components are provided as before. First portion 22, the second portion generally defining a chamber for receiving battery 12, and the first electrical connection means associated therewith are all generally incorporated as part of a first planar section 57 of housing 56, which section 57 is substantially received within pocket 52.

Housing 56 includes a second planar section 58 which is joined at its uppermost edge with first planar section 57 of housing 56. Second planar section 58 is provided generally parallel with and exterior to pocket 52. Section 58 also provides structure to which second housing or lamp unit 32 may be attached for support, and by which electrical connection therewith may be made.

Mounting pins such as 28 and 30 may be utilized with a construction as in FIG. 4, but are not required. Electrical wiring may be utilized in their stead, and housing 32 may be welded, glued or the like to section 58, thereby obviating any need for such mounting pins. As is well understood by one of ordinary skill in the art, the structure of first housing 56 of FIG. 4 requires that wires of the like be passed from battery 12, through electronic components received in portion 22, across the top joining portion of housing 56, and descend down through planar section 58 to a point where they may be physically associated with lamp unit 32 for providing electrical power thereto.

Figure 5:
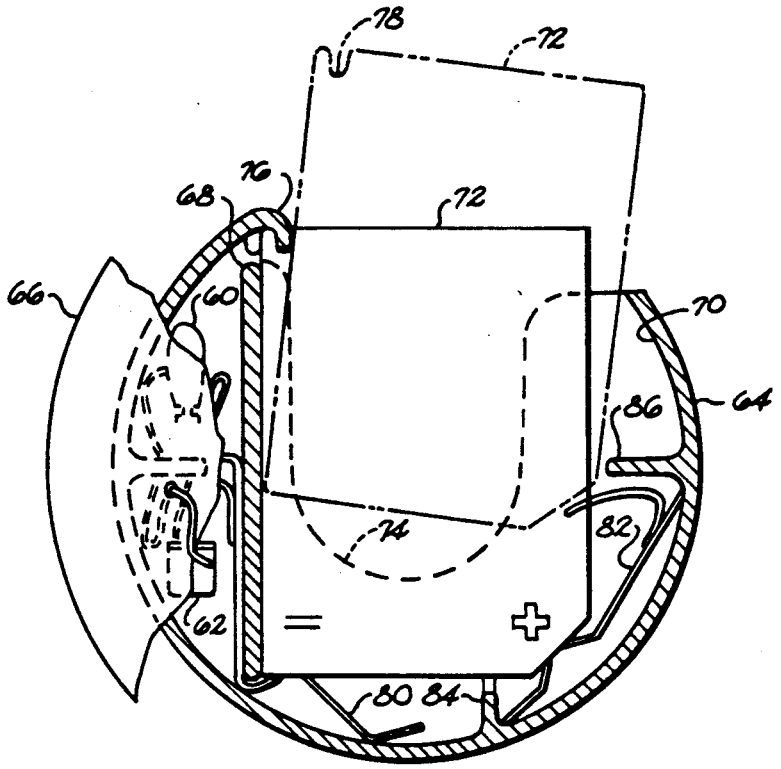
FIGS. 5–7 illustrate a perspective frontal view, a cross-section side view, and a perspective top view, respectively, of still another embodiment of an apparatus embodying features in accordance with this invention.
Figure 6:
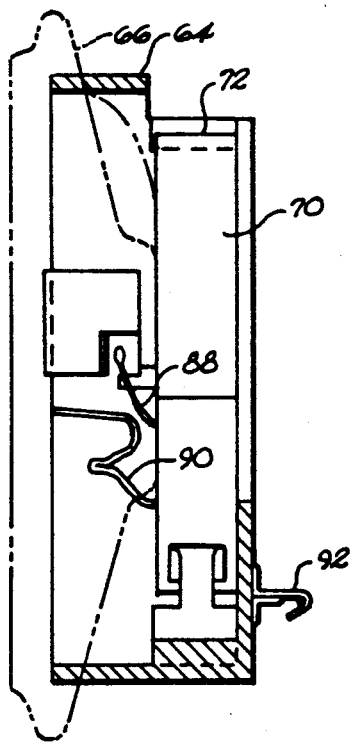
Figure 7:
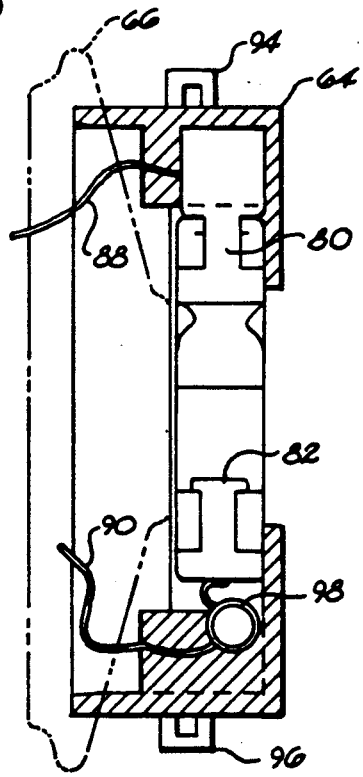

The embodiment of FIGS. 5-7 may utilize a lamp unit virtually identical to lamp unit 32, but also omitting mounting pins in lieu of using connecting wires, as may be practiced with FIG. 4.

In general, the same types of electrical components and circuits which may be used with the above-discussed embodiments of this invention may also be used with a construction as illustrated in FIGS. 5-7. Therefore, such components, such as elements 60 and 62, are shown schematically only for purposes of reference.

FIG. 5 illustrates a frontal view, in section, of a first housing 64 (generally circular in nature), with a portion of generally circular lamp unit 66 (a second housing) illustrated in front of housing 64. An internal wall 68 of housing 64 substantially defines a separate or first portion of housing 64 with electronic components 60 and 62 enclosed therein. As discussed, a substantially sealed arrangement as illustrated may afford a degree of protection for such components which can prolong their lifetime by preventing contamination from dust, dirt, or direct physical contact. In essence, only required electrical connectors penetrate such enclosed portion, to provide electrical power from a battery to such electrical components, and take outputs away from such components.

The remainder of housing 64 which is not essentially sealed off by internal wall 68 generally defines a chamber 70, which is adapted for receipt of battery 72 therein. Such battery may comprise any standard and commercially available battery which fits such chamber, such as an Ever-Ready model 539, size J.

The solid line illustration of battery 72 in FIG. 5 shows the position of such battery whenever it is completely in place within chamber 70 so as to switch on (i.e., provide power) to electrical components 60 and 62. The broken line representation of battery 72 illustrates such battery partially removed (or partially introduced) relative chamber 70. No electrical power is provided to electrical components 60 and 62 whenever battery 72 is in such partial position. Hence, analogous to previous embodiments, introduction and removal of battery 72 from chamber 70 of housing 64 automatically provides an on/off switching function for electrical components received within housing 64.

The dotted line U-shaped portion 74 of housing 64 illustrates a cut down back wall thereof. Such a cutaway of the housing enables ready access to and grasping of battery 72 for its removal or introduction relative chamber 70.

Projection 76 projects from housing 64 into an edge of chamber 70, and provides an engagement surface for engaging a portion of battery 72 (in particular, notch 78 located on one upper corner thereof). First electrical connection means of the construction per FIGS. 5-7 may include spring-loaded contacts 80 and 82, which also function in cooperation with extended engagement member 76 in securing and holding battery 72 within chamber 70. As is illustrated by FIG. 5, internal projections 84 and 86 located within housing 64 are sufficiently withdrawn from the static installed position of battery 72 (shown by its solid line illustration in FIG. 5) to permit such battery to be further pushed into chamber 70 for release of notch 78 from projection 76. While the battery is installed, spring-loaded members 82 and 80 cause battery 72 to be biased against engagement extension 76, and hence be held within chamber 70.

Second housing 66 forming a lamp unit (shown only in dotted line form in FIGS. 6 and 7) is substantially identical to second housing 32 shown with earlier embodiments of the present invention. Lamp unit 66 may specifically be identical to lamp unit 32, or in the alternative may omit the openings used in lamp unit 32 in favor of direct receipt of and connection with electrical wires 88 and 90, illustrated in FIGS. 6 and 7. Wires 88 and 90 may in such instance comprise second electrical connection means in place of pins 28 and 30 for connecting the electrical output of electrical components within housing 64 to points exterior to such housing. Since lamp unit (or second housing) 66 is shown in dotted line in FIGS. 6 and 7, for purposes only of illustrating its intended structural relationship with first housing 64 electric lines 88 an 90 are not specifically illustrated as connected to the leads with which they would normally be associated, which leads directly connect to a light bulb received within lamp unit 66.

FIG. 6 is substantially a side view of housing 64. The back wall of housing 64 appears to be partially cut away, which is intended as illustrative of U-shaped portion 74 (also shown in dotted line in FIG. 5). While chamber 70 is not readily visualized from a view such as shown in FIG. 6, battery 72 is indicated for purposes of demonstrating the size of such battery relative housing 64 and lamp unit 66. As is apparent from all three of FIGS. 5-7, both lamp unit 66 and housing 64 are relatively circular, with the diameter of lamp unit 66 being larger than that of housing 64. Hence, during use, lamp unit 66 substantially conceals the power pack or first housing 64 from the view of those who perceive use of the invention.

In preferred embodiments of the construction of FIGS. 5-7, mounting and conductive pins such as 28 and 30 are omitted in favor of the use of direct electrical connections with lines 88 and 90, as discussed above, and alternative mounting features. Therefore, no pin arrangement is available to secure such a modular electronic badge to a user or clothing worn by the user. FIG. 6 illustrates a clasp base 92 for a safety pin type arrangement (not illustrated) which may be attached to the back of housing 64. Alternatively, as illustrated in FIG. 7, elements 94 and 96 may be provided on opposing sides of housing 64 so that the entire modular electronic badge may be worn with a chain or string (attached to elements 94 and 96) as a necklace or the like.

FIG. 7 illustrates a top view of the FIG. 5 apparatus, with the battery removed. Visible at the bottom of housing 64 are spring-loaded contacts 80 and 82. For purposes of schematic illustration, contact 82 is shown as connecting with electrical line 90 through electrical components 98. Similarly, spring-loaded contact 80 is in electrical connection with electric line 88.

As discussed above, lines 88 and 90 may be directly connected to leads associated with a light bulb received within light unit 66, during assembly of a construction per FIGS. 5-7. Hence, housing 64 comprises a power pack or power unit for providing controlled electric power from a battery through electrical components to a lamp received within lamp unit 66. Similar to the FIG.

4 embodiment disclosed above, lamp unit 66 may be welded, glued, or the like into a specific physical relationship with housing 64, such as the one indicated in FIGS. 6 and 7.

As is well understood from the foregoing disclosure, the functional and structural aspects and features of the present invention provide useful and effective solutions to drawbacks of some prior products, noted above. Numerous modifications and variations of the particular exemplary embodiments disclosed herewith may be made and used by those of ordinary skill in the art without departing from the spirit and teachings of this invention.

For example, a housing other than the particular circular or rectangular, planar embodiments shown may be utilized. Likewise, numerous other equivalent methods of attaching to or associating the badge with a user may be practiced, all of which come within the teachings of the present invention.

Furthermore, the presently disclosed embodiments are by way of example only, and are not intended to limit the present invention. For example, it is not essential that electrical components be disposed within a housing precisely in the orientations illustrated, nor that electrical inner-connections therebetween be achieved explicitly and only in the manner shown. All illustrations and language describing same are words of description only, and are not intended as limitations. Any and all modifications and variations which would occur to one of ordinary skill in the art come within the broader scope of the present invention, which scope is limited only by the appended claims.

What is claimed is:

1. A battery-operated electronic apparatus, comprising:

a first housing having electronic circuitry protectively enclosed therein, said first housing defining a chamber which opens to the exterior of said first housing, and which is adapted to receive a battery, said first housing further including an engagement member integral therewith for retaining a battery within said chamber slidably introduced thereto; and a second housing having an electrical load enclosed therein, said second housing being removably supported on and electrically associated with said first housing, whereby said electrical load may be driven by said electronic circuitry when said is powered by a battery received in said chamber; wherein said chamber includes contact means for electrically engaging a battery retained therein by said engagement member, receipt of which automatically provides power to said electronic circuitry as such battery is slidably situated relative said engagement member.

2. An apparatus as in claim 1, wherein said electrical load comprises an incandescent bulb, and said electronic circuitry comprises a flashing circuit for causing said bulb to light intermittently.

3. An apparatus as in claim 2, wherein said second housing further includes interchangeable lens covers selectively mounted thereon so as to be backlit by said bulb.

4. An apparatus as in claim 1, wherein said electronic circuitry comprises electrical components which produce audible sounds including one of musical tones and electronic voice sounds.

5. An apparatus as in claim 1, further comprising:

electrical output and support means, including two members which extend from said first housing, for providing an electrical output from said electronic circuitry and structure for physically receiving said second housing thereon; and wherein said second housing defines a plurality of openings for receipt of said two members in selected pairs of said openings, the orientation of said second housing relative said first housing being variable in accordance with the particular pair of openings selected for receipt of said two members.

6. An apparatus as in claim 1, wherein said contact means includes spring-loaded contacts for electrical contact with a battery placed within said chamber, and wherein said engagement member comprises a projection extending from said first housing into said chamber for selectively engaging said battery and holding same within said chamber.

7. A modular electronic badge to be worn by an individual, comprising:

a power unit defined by a housing having (a) a first enclosed interior space with electronic circuit components protectively received therein, said components when powered providing an output in accordance with a desired function, (b) a second partially enclosed space, adjacent said first space, adapted for receipt of a battery to power said circuit components, said second space being open on at least one side thereof direct to the exterior of said housing so as to permit introduction of a battery thereinto without disturbing the enclosure of said first space, (c) an insulated engagement member, integral with said housing, for retaining a battery within said second space slidably received therein, (d) first electrical contact means for providing electrical connection between said first and second spaces to supply power from a battery retained within said second space by said engagement member to said electronic components enclosed within said first space, and (e) second electrical contact means for supplying said output from said electronic components to the exterior of said housing, said output being suitable for driving an electric load, introduction and removal of a battery in and out of said second space automatically switching power on and off, respectively, between such battery and said electronic components through said first electrical contact means; and further comprising a lamp unit, supported on said power unit housing, exterior to said first and second spaces thereof, said lamp unit including an electric load comprising a light received therein and controllably powered by said electronic components through operative association with said second electrical contact means and said output supplied thereby; wherein a battery may reside within said second space for storage thereof without being engaged by said engagement member, and then be selectively moved by a user into operative association with said engagement means so as to supply power through said first contact means to said electronic components.

8. A modular badge as in claim 7, wherein:

said electronic components comprise electrical flashing circuits for causing said electric light to be operated intermittently; and said lamp unit further includes a changeable lens member which is positioned so as to be backlit by said electric light.

9. A modular badge as in claim 7, wherein:

said second electrical contact means comprise two rigid members extending outward from said power unit; and said lamp unit defines a plurality of paired openings for matably receiving said rigid members in selected pairs of said openings, whereby said lamp unit is physically supported on said rigid members and said electrical light is powered by said electrical output supplied by said rigid members.

10. A modular badge as in claim 7, wherein:

said second electrical contact means comprise two wires adapted for electrical connection with leads of said electric light for supplying power thereto;

said housing and said lamp unit principally comprise plastic materials; and said modular badge further includes a solvent weld for holding said housing and said lamp unit together.

11. A modular badge as in claim 7, wherein said housing comprises two bifurcated planar sections joined at respective edges thereof, the first planar section generally including said first and second spaces and said first electrical contact means, the second planar section generally including said second electrical contact means, and wherein said bifurcated housing is adapted to be worn with a shirt pocket, with said first planar section being received within such shirt pocket and said second planar section being outside of such shirt pocket.

12. A modular badge as in claim 8, wherein said changeable lens comprises black solar resistive plastic which is opaque when not backlighted, and said lens includes a desired design thereon such that backlight illumination of said lens by said electric light provides lighted display of such design.

13. A modular badge as in claim 7, wherein said housing further includes attachment means for securing said power unit to a user of the badge or clothing worn by such user.

14. A modular badge as in claim 7, wherein:

said first electrical contact means include spring-loaded contact mounted on said housing within said chamber, said spring-loaded contact having leads which extend into said first space of said housing and electrically connect with said electronic components to provide power thereto from a battery received within said second space.

15. A modular badge as in claim 7, wherein said power unit and said lamp unit both generally have circular shapes, with the diameter of said lamp unit being greater than that of said power unit so that the power unit may be concealed behind the lamp unit during use of the badge.

16. A modular badge as in claim 7, wherein:

said power unit is generally rectangular in shape, relatively flat in profile, and about the size of a standard shirt pocket; and said lamp unit is generally circular in shape.

17. A battery-operated modular electronic novelty badge, comprising:

a power pack unit, adapted to be worn by a user, having electronic circuitry protectively enclosed therein, and defining a chamber which opens to a exterior of said power pack unit to permit introduction and removal of a battery without having to open said unit, said unit further including insulated friction engagement means integral therewith for retaining a battery slidably received within said chamber;

electrical contact means, associated with said power pack unit, for electrically connecting a battery received with said chamber with said electronic circuitry, and for providing an electrical output from said electronic circuitry; and a lamp unit having an electric light, said lamp unit adapted to be physically supported by said power pack unit and operatively associated with said electrical contact means so that said electric light is controllably powered by said electronic circuitry;

whereby said introduction and removal of said battery comprises an automatic on/off switching function for said electronic circuitry powering said electric light.

18. A novelty badge as in claim 17, wherein:

said electronic circuitry comprises an electrical flashing circuit for causing said lamp unit light to operate intermittently;

said electrical contact means includes two electrically-conductive pin elements, extending from said power pack unit and having leads which connect with said electronic circuitry;

said lamp unit defines a plurality of openings, selectable pairs of which are adapted for mated operative and electrical connection with said two pin elements so as to provide physical support of said lamp unit and provide power to said electric light, whereby receipt of said pin elements within a selected given pair of said openings permits selectable orientation of said lamp unit relative said power pack unit; and wherein said lamp unit is adapted to detachably receive one of a set of interchangeable lenses for association with said light so as to be backlit thereby, each of said lens having a design unique with respect to one another, which design is displayed whenever said light operates but is not visible whenever said light is off.

19. A novelty badge as in claim 17, wherein:

said electronic circuitry comprises an electrical flashing circuit for causing said lamp unit to burn intermittently;

said electrical contact means includes two wires adapted for connecting leads associated with said electric light with leads connected to said electronic circuitry, and further includes two spring-loaded contacts for connecting a battery with said electronic circuitry while resiliently retaining such battery in engagement with said friction engagement means;

said lamp unit is adapted to detachably receive one of a set of interchangeable lenses for association with said light so as to be backlit thereby, each of said lens having a design unique with respect to one another, which design is displayed whenever said light operates, but is not visible whenever said light is off; and wherein said badge further includes glue means for securing said lamp unit to said power pack unit.

* * * * *